United States Patent [19]

King

[11] Patent Number: 4,738,380

[45] Date of Patent: Apr. 19, 1988

[54] SELF-ADJUSTING REFRACTORY JOINT

[75] Inventor: Patrick D. King, Rantoul, Ill.

[73] Assignee: Flo-Con Systems, Inc., Champaign, Ill.

[21] Appl. No.: 834,576

[22] Filed: Feb. 28, 1986

[51] Int. Cl.[4] ..... B22D 35/00; C21B 7/06

[52] U.S. Cl. ..... 222/606; 222/512; 266/285; 403/30; 285/905; 285/406

[58] Field of Search ..... 222/591, 606, 512; 266/285; 403/30, 28; 285/905, 406, 364, 140

[56] References Cited

U.S. PATENT DOCUMENTS

| | | | |
|---|---|---|---|
| 3,386,723 | 6/1968 | Miller | 222/591 X |
| 3,549,061 | 12/1970 | Piene | 222/591 |
| 4,063,668 | 12/1977 | Shapland et al. | 222/512 |
| 4,299,018 | 11/1981 | Bickerstaff et al. | 403/30 X |
| 4,576,218 | 3/1986 | Artz et al. | 222/607 X |

FOREIGN PATENT DOCUMENTS

| | | | |
|---|---|---|---|
| 0085658 | 5/1982 | Japan | 222/591 |
| 1260555 | 1/1972 | United Kingdom | 222/591 |

*Primary Examiner*—Joseph J. Rolla

*Assistant Examiner*—Gregory L. Huson

*Attorney, Agent, or Firm*—Jack E. Dominik

[57] ABSTRACT

A self-adjusting refractory joint which finds principle utility in teeming valves in which a pair of overlapping collars are provided on a plate and on the pour tube, the collar on the plate extending downwardly in surrounding relationship to the teeming orifice, and the collar on the pour tube extending from its upper portion in overlapping interfering relationship with the collar on the plate. Ideally the tangent of the angle (theta) of undercut between the respective collars where they overlap is the ratio of the height of the collar of the inner member divided by the radius of the outside diameter (O.D.). In the precast environment, an independent preformed retainer is used to define the extension from the bottom of the plate. In both instances a holder surrounds the extension from the bottom of the plate to essentially the bottom of the plate collar forming member. When the angle is ½ theta or any other ratio the angles can be generated graphically by extending an imaginary line from the outside of the tube collar to the teeming opening center.

4 Claims, 2 Drawing Sheets

SELF-ADJUSTING REFRACTORY JOINT

FIELD OF THE INVENTION

The present invention relates to a self-adjusting refractory joint which finds particular utility in sliding gate valves in those situations where a pour tube or shroud is to be joined to a flat plate. Normally the flat plate is one of the fixed plates, but it can also be movable.

SUMMARY OF THE PRIOR ART

The general prior art is in the field of sliding gate valves. These are represented as shown in U.S. Pat. No. Re. 27,237 and sliding gate valves such as shown in Flo-Con U.S. Pat. No. 4,063,668.

The pour tube or shroud can be used to shield the metal while it is being poured from ambient, or can actually extend far enough into the pouring area so that it is submerged during the time of the pour. Usually such pour tubes are highly resistant to thermal shock, and have a low coefficient of thermal expansion. On the other hand, a monolithic cast mounting for a plate to which the shroud or pour tube is to be joined has a significantly higher coefficient of thermal expansion. This is true whether the slab or plate portion is monolithic cast, or preformed. A solid body with a hole such as a teeming opening expands radially from the geometric center. The hole behaves as though the entire refractory was solid. The hole will contract or keep its same diameter only if very solidly embedded in containment such as banding, or embedding in a further casting. Even then, the metal banding at a given temperature will expand outwardly adjacent the refractory and permit the hole to expand. The same is true when embedded.

It thus becomes important to create a joint between the two disimilar materials in which the ones will not tend to expand away from the other and open up a joint through which metal can pass in its fluid state. In certain applications where only the shroud is employed, a metallic holder will extend downwardly on the tubular extension and hold it in position and generally maintain a thrust relationship at the butt joint. Where the tube is to be submerged, however, a holder would melt in the submerged configuration and therefore the joint should be self-adjusting if at all possible.

SUMMARY OF THE INVENTION

The present invention is directed to a self-adjusting refractory joint which finds principle utility in teeming valves in which a pair of overlapping collars are provided on a plate and on the pour tube, the collar on the plate extending downwardly in surrounding relationship to the teeming orifice, and the collar on the pour tube extending from its upper portion in overlapping interfering relationship with the collar on the plate. Ideally the tangent of the angle (theta) of undercut between the respective collars where they overlap is the ratio of the height of the collar of the inner member divided by the radius of the outside diameter (O.D.). In the present environment, an independent preformed retainer is used to define the extension from the bottom of the plate. In both instances a holder surrounds the extension from the bottom of the plate to essentially the bottom of the plate collar forming member. When the angle is ½ theta or any other ratio, the angles can be generated graphically by extending an imaginary line from the outside of the tube collar to the teeming opening center line in a section view.

In view of the foregoing it is a principle object of the present invention to provide an expansion joint useful in teeming valves which will self-adjust for the coefficient of expansion of two disimilar materials.

A related object of the present invention is to provide a self-adjusting refractory joint which permits the alternative usage of prefired plates or monolithic plates, either of which have the same metallic holder.

Yet another object of the present invention is to provide a self-adjusting expansion joint at no significant increase in cost for the particular application.

BRIEF DESCRIPTION OF THE DRAWINGS

Further objects and advantages of the present invention will become apparent as the following description of an illustrative embodiment proceeds taken in conjunction with the accompanying drawings, in which.

Figure 3:
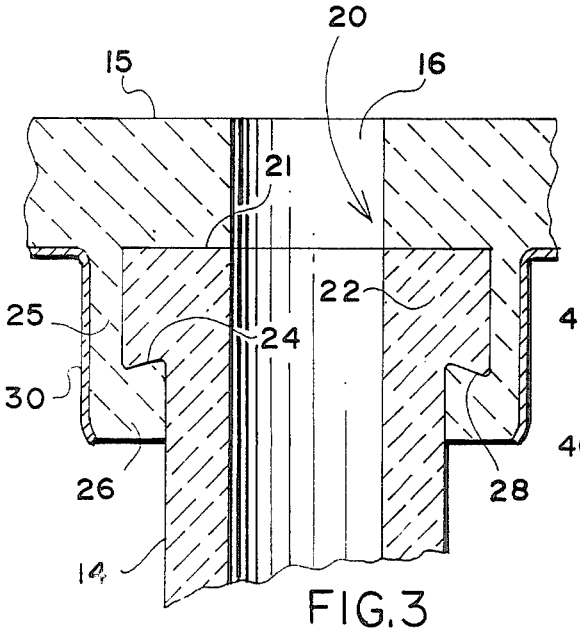
Figure 4:
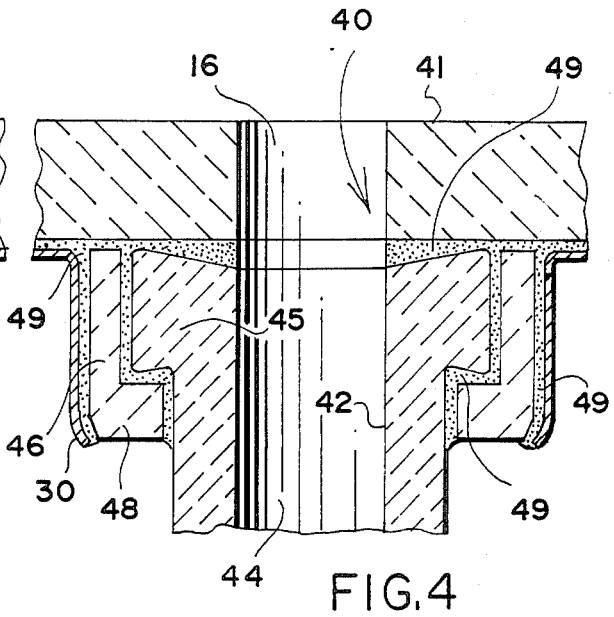
Figure 5:
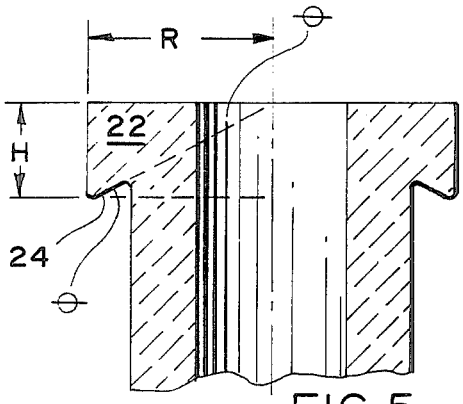
Figure 6:
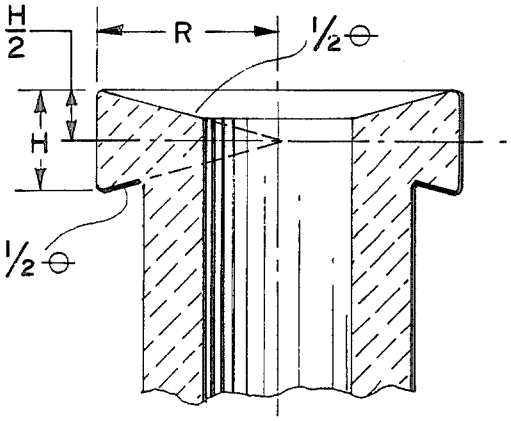
Figure 7:
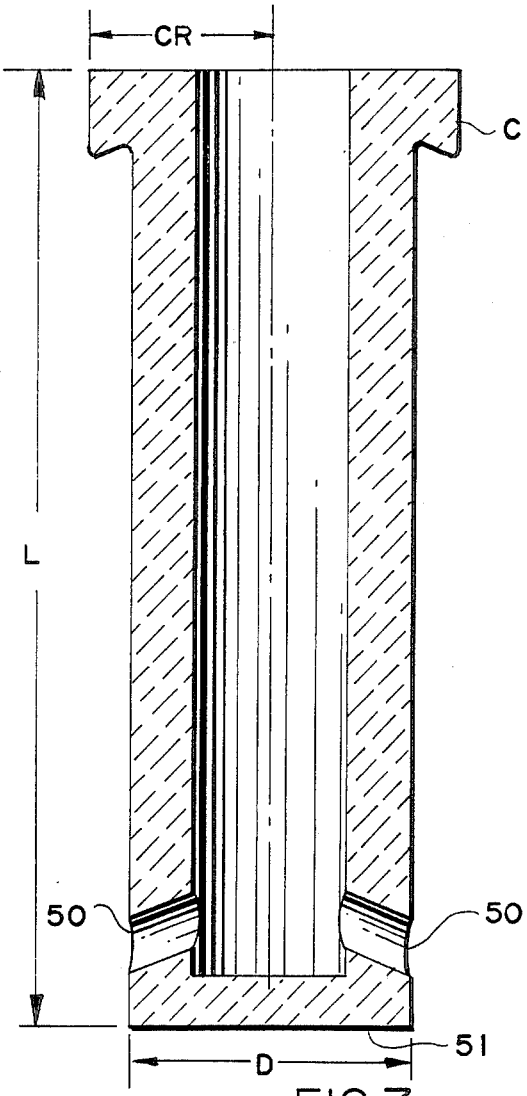

FIG. *2a* is a perspective partially diagrammatic view illustrating the plate and pouring tube from an upward vantage point and in which the present expansion joint finds its utility, the lower end of which shows one embodiment in which the tube bottom is closed and the metal is discharged through lateral tube ports;

FIG. *2b* is a comparable perspective view to FIG. *2a* except taken from underneath, and showing the pour tube having a teeming opening which is directly through the bottom of the pour tube;

FIG. 3 is a broken transverse sectional view of the expansion joint taken essentially along section line 3—3 of FIG. *2a* and FIB. *2b*. It shows a monolithic cast plate;

FIG. 4 is a view taken along section line 3—3 of FIG. *2a* and FIG. *2b* but showing it in the environment where a plate and preformed retainer are employed;

FIG. 5 is a view taken from the same vantage point as FIG. 3, but showing the upper end of the pour tube and specifically its collar;

FIG. 6 shows the development of the angle theta in the expansion joint as illustrated in FIG. 4; and FIG. 7 is a transverse section view of a typical pour tube of a commerical embodiment.

Figure 1:
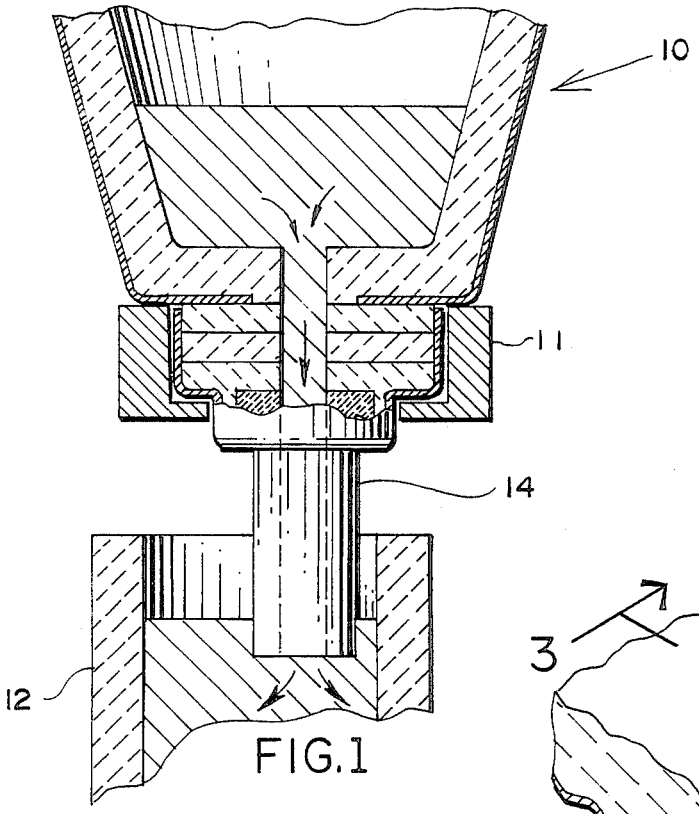
FIG. 1 is a partially diagrammatic transverse sectional view illustrating a bottom pour vessel, valve, and pour tube of the type contemplated as requiring the self-adjusting expansion joint of the present invention.

DETAILED DESCRIPTION OF A PREFERRED EMBODIMENT:

As set forth above, the present invention finds utility in a system such as shown in FIG. 1 where a bottom pour vessel 10 has a sliding gate valve 11 mounted in teeming relationship at its lower portion and a pour tube 14 extends into a mold, ingot, or other vessel 12 into which metal is being poured. The pour tube 14 may be submerged as shown in FIG. 1, or it may be shorter in the form of a shroud. Its principal function is to confine the stream of teeming metal and to shield the same from ambient environment. More specifically as shown in perspective FIG. *2a*, the assembly includes a plate 15 having a plate teeming opening 16 and a depending pour tube 18. The pour tube opening 19 is in teeming relationship with the plate teeming opening 16.

Figure 2A:
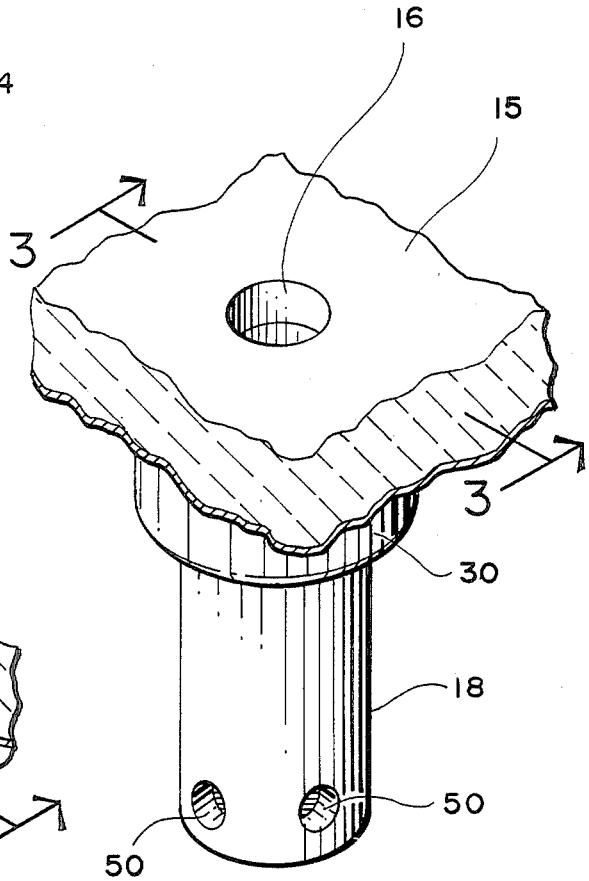
Figure 2B:
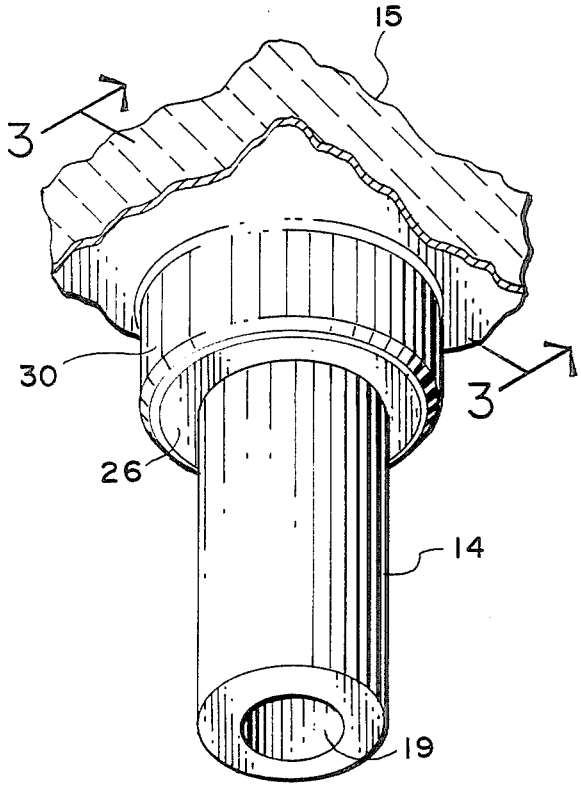

The pour tube shown in FIG. *2a* has lateral tube ports 50, and and a closed teeming opening bottom (not shown in this Figure). In FIG. *2b*, the pour tube 14 has a pour tube opening 19 extending through its lower portion, as contradistinguished from the lower end portion of the pour tube in FIG. 2*a*.

Turning now to FIG. 3, it will be seen that the expansion joint 20 includes a pour tube 14, the upper end of which is in abutting relationship with the monolithic plate 15. A collar 22 is provided at the upper portion of the pour tube 14, and at its lower portion has an undercut 24. The extension 25 of the monolithic plate 15 extends downwardly beyond the pour tube collar 22, and terminates in a lower collar 26 which has a complimentary undercut 28 to match the undercut 24 of the collar 22 of the pour tube 14. The extension 25 of the plate 15 is surrounded by a metallic holder 30 which underlies the plate 15 as well.

Determining the angle theta for the undercut 24 is illustrated in FIG. 5. There it will be seen that the angle is that angle which has a tangent which is equal to the height H of the collar 22 divided by the radius R of the outside diameter of the pour tube collar. The angle can also be determined geometrically as shown by drawing an imaginary line from the bottom of the collar to the center line of the radius of the collar. Conversely, the same angle is generated by the same imaginary line, and a horizontal line from the lower end of the collar to the center line of the pour tube. This is the optimum angle, but the formulation holds valid only in those cases where the radius to the outside diameter of the collar exceeds the height of the collar.

An alternative embodiment is shown in FIG. 4 where it will be seen that the alternative joint 40 is formed for a preformed plate 41 in conjunction with pour tube 42. The tube opening 44 is in abutting teeming relationship with the teeming opening of the plate 41. In this instance a dovetailed collar 45 extends from the upper portion of the pour tube, and a preformed retainer 46 extends downwardly from the plate 44 and at its lower portion has a collar 48. The entirety of the preformed retainer 46 is imbedded in mortar 49. A metallic retainer 30, similar to the metallic retainer 30 for the monolith shown in FIG. 3, is provided and it is also mortared in place. In this instance it will be seen that there is no undercut on the preformed support collar 48, and it will be seen further that the angle at the upper portion of the dovetailed collar 45, and at its lower portion represents one-half of the single angle employed with the monolith as shown in FIG. 3. Developing the angle of the two undercuts of the dovetail 45 is done in the same fashion as described with regard to FIG. 5 just above, and then the angle split between the upper surface and the lower surface of the dovetail collar 46. This is shown in FIG. 6.

Another theory of the development of the angle of the dovetail or the undercut is that it is a frustoconical section taken by an element of a cone generated with its vertex at the center line of the pour tube and where the center line intersects the upper end and extending downwardly to the base of the collar of the pour tube. The two frustoconical sections involved in the alternative embodiment as shown in FIG. 4 are generated by a rotating element but with half the angle as developed in accordance with the description of FIG. 5. Actual dimensions are not critical to the particular construction as long as the interference is provided at the joint between the pour tube collar and the extension from the plate. Within certain limits, the coefficient of thermal expansion between the two disimilar materials can be readily tolerated. In addition the angles can be varied by shifting the intersection of the imaginary lines as shown in FIG. 6 up and down the center axis of the teeming opening but within the parallel planes defined by the upper and lower extremes of the collars 22 and 45.

In FIG. 7 a typical pour tube is shown having a length L which varies. The collar C has an outside diameter and a collar radius CR. The diameter of the pour tube D is shown at the bottom. In this instance the pour tube 16 is provided with lateral ports 50 at the bottom for discharging the teeming metal. The bottom is closed by a bottom end 51. The angles of the collar are developed in accordance with the embodiments disclosed in either FIGS. 3 or 4 and diagrammatically generated as disclosed in FIGS. 5 and 6.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification, and appended claims.

What is claimed is:

1. A self-adjusting refractory joint for use in teeming metals where a plate having a teeming opening is joined to a pour tube having a teeming opening and where the refractories are disimilar, comprising, in combination:

a pour tube terminating in an upper end and having a collar at its upper portion extending outwardly, said collar having at least one angled undercut, a plate having a teeming opening in teeming relationship with the pour tube, a downward extension from the plate, said downward extension having an inwardly extending collar for support relationship with the pour tube collar, said pour tube collar angled undercut narrowing the collar height at its inner position in which the totality of the undercut angle relates to the ratio of the collar height to the collar O.D. radius , said plate being monolithic, said extention with said inwardly extending collar being monolithic and poured to have a mating relationship to the collar on the pour tube, said pour tube having a coefficient of linear expansion significantly less than that of the monolithic plate and monolithic extension.

2. In the expansion joint of claim 1, said plate being a preformed fired refractory, said plate having a depending preformed retainer with a collar at its lower portion, said retainer, pour tube, and plate being secured in mortared relationship.

3. In the expansion joint of claim 1, said plate being a preformed refractory, said plate having a monolithic extension with a collar poured in mating relationship to the collar on the pour tube.

4. An expansion joint for use with the teeming of metals through a teeming opening in plate and a depending pour tube having a teeming opening, said tube have a coefficient of linear expansion significantly less than the plate comprising, in combination, an extension proceeding downwardly from said plate and terminating in an inwardly extending collar, said extension having a coefficient of linear expansion significantly greater than the tube, an annular collar extending laterally from the upper end of said depending pour tube, said pour tube collar having a height defined by upper and lower extremes of said collar and having a dovetail exterior with an upper frustonconical face and a lower frustoconical face, said pour tube collar being supported by said extention, said frustoconical faces being aligned along a segment generated by two radii, one from the upper extreme of the pour tube collar at it's outermost region and one from the lower extreme of the pour tube collar at it's outermost region and which intersect at a central longitudinal axis of said pour tube, said radii intersection falling within two parallel planes perpendicular to said longitudinal axis and defined by said collar height.

* * * * *